United States Patent [19]

Saylor et al.

[11] 4,064,502

[45] Dec. 20, 1977

[54] POSITIONING CONTROL SYSTEM FOR ALPHANUMERIC DISPLAYS

[75] Inventors: William H. Saylor, South Laguna; James O. Narey, Westminster, both of Calif.

[73] Assignee: Associated Data Concepts, Costa Mesa, Calif.

[21] Appl. No.: 638,390

[22] Filed: Dec. 8, 1975

Related U.S. Application Data

[63] Continuation-in-part of Ser. No. 547,081, Feb. 4, 1975, abandoned.

[51] Int. Cl.[2] ..... G09F 9/00

[52] U.S. Cl. ..... 340/324 R; 40/31; 40/93; 340/325; 340/379

[58] Field of Search ..... 340/324 R, 325, 379; 178/34, 35, 28, 29, 32, 38, 39; 40/31, 52 R, 46, 93, 92, 117, 82–86, 347, 106.51, 106.52, 106.53

[56] References Cited

U.S. PATENT DOCUMENTS

| | | | |
|---|---|---|---|
| 1,016,944 | 2/1912 | Kent | 40/31 |
| 1,872,145 | 8/1932 | Hurford | 40/93 |
| 2,167,505 | 7/1939 | Griffith | 178/34 |
| 3,510,583 | 5/1970 | Kern | 178/34 |
| 3,582,937 | 6/1971 | Dozer | 340/324 B |

*Primary Examiner*—Marshall M. Curtis

*Attorney, Agent, or Firm*—Reising, Ethington, Barnard

[57] ABSTRACT

A destination sign for buses is disclosed with an automatic positioning system for a plurality of sign modules. The sign is made up of plural modules, each of which is capable of displaying any one of a set of alphanumeric characters. The display of a module is changed from one character to another by displacement through successive, equal angular increments. The positioning system comprises a reversible drive motor and a common shaft with a separate positioning clutch for coupling each display module to the shaft. The positioning clutch for each module is controlled by a command signal produced by a punch card reader and a shaft position encoder. Various words to be displayed by the sign are encoded on respective punch cards and insertion of a selected punch card into the card reader causes the positioning system to execute a reset cycle and a positioning cycle to display the selected name.

21 Claims, 18 Drawing Figures

LEGEND:

▷ DISPLAY PICK-UP POINT FOR START OF MOVEMENT

∘ DISPLAY STOPS MOVEMENT

▷——∘ LENGTH OF DISPLAY MOVEMENT

- - - - DISPLAY IDLE

POSITIONING CONTROL SYSTEM FOR ALPHANUMERIC DISPLAYS

This is a continuation-in-part of patent application Ser. No. 547,081 filed Feb. 4, 1975, now abandoned.

BACKGROUND OF THE INVENTION

Automatically changeable printed signs of the roller curtain type are used notably for destination signs on buses and trains. In this application a printed opaque display is preferred because of its readability under widely varying conditions of ambient light. Destination signs must be changeable according to the particular route of the vehicle and each sign must be capable of displaying a large number of different destination names. A typical destination name may require forty or more alphanumeric characters and the sign must be changeable quickly from one name to another.

In the past, destination signs have taken the form of a roller curtain wide enough to accommodate the requisite number of characters and long enough to hold a full set of destination names required for a given transit vehicle. One difficulty with this type of destination sign is that the roller curtains must be printed with a special set of destination names, according to the route of the vehicle on which it is to be used. This requires printing of a large number of different destination signs for each metropolitan area.

A universal destination sign has been developed in which any alphanumeric destination name may be displayed by forming any desired alphanumeric character in any one of plural window areas. Identical sets of printed roller tapes are used for each window area with each set being capable of displaying any desired character by properly positioning the tapes of the set. The individual tapes of a set carry plural segments of different characters and the tapes of the set must be positioned relative to each other such that all segments of a given character may be displayed together. This sign is truly universal in that it utilizes a broken-character, broken-word arrangement and has the advantage of being able to form any combination of characters with the use of relatively short display tapes. Such a destination sign is disclosed and claimed in copending patent application Ser. No. 546,696 filed Feb. 3, 1975 by William H. Saylor and James O. Narey and entitled Changeable Information Display.

Such a broken-character, broken-word destination sign requires individual positioning of each set of tapes to form the character to be displayed in the respective window area. In order to change the sign quickly, all sets of tapes must be reset concurrently as opposed to the time consuming procedure of resetting them one after the other. Because of the broken character arrangement, precise positioning of each set of tapes is required to faithfully reproduce each character.

THE PRIOR ART

The prior art includes automatic positioning systems for alphanumeric, changeable printed signs, such as that shown in the Dozer U.S. Pat. No. 3,582,937. In the system of the Dozer patent, a single tape is provided in each window area and carries a full set of alphanumeric characters each shown in its entirety. All of the tapes are selectively movable independently of each other to display one of the characters on the respective tapes. This sytem uses a separate drive motor for each of the tapes and the positioning is achieved by a closed loop system.

SUMMARY OF THE INVENTION

According to this invention, a changeable, alphanumeric printed display is provided with automatic individual positioning of plural character displays in a concurrent manner by means of a common motor and shaft. In general, this is accomplished by means of an open-loop positioning system with each character display positioned through a separate clutch means controlled by individual command signals.

The positioning apparatus comprises a common drive shaft and a reversible motor for all of said devices with separate clutch means adapted to couple the respective devices to the shaft. A selector means produces a desired position signal for each display device and a shaft position encoding means connected with the drive shaft produces a shaft position signal. Motor control means, respective to the encoding means, energizes the motor in a reverse direction to drive each display device to a home position and energizes it in a forward direction when the home position is reached. The encoding means is connected with the selector means to produce a command signal when the shaft position signal bears a predetermined relation to the desired position signal for each device. Clutch control means is responsive to the command signals for selectively engaging each of the clutch means to couple the display devices to the shaft during shaft displacement corresponding to the rotational distance between the home position and the desired position for the respective device.

Further, according to this invention, the clutch means is operative to drive its respective display device from its home position to its selected position and to hold it there; it is also operative to drive the display device for resetting it from its previously selected position to its home position. This is accomplished by a clutch means in the form of a differential device having an input member connected with the shaft, an output member connected with the display device and a control member which is operative to effect coupling or decoupling of the input and output members. The control member is actuated by a primary operating member for use in setting the display device to its selected position and by a secondary operating member for use in resetting the display device. Preferably, the clutch means takes the form of a planetary gear set; the primary operating member is a solenoid actuated latch and the secondary operating member is a variable limit stop.

DETAILED DESCRIPTION OF THE INVENTION

A more complete understanding of this invention may be obtained from the detailed description that follows, taken with the accompanying drawings in which.

MECHANICAL ARRANGEMENT

Figure 1:
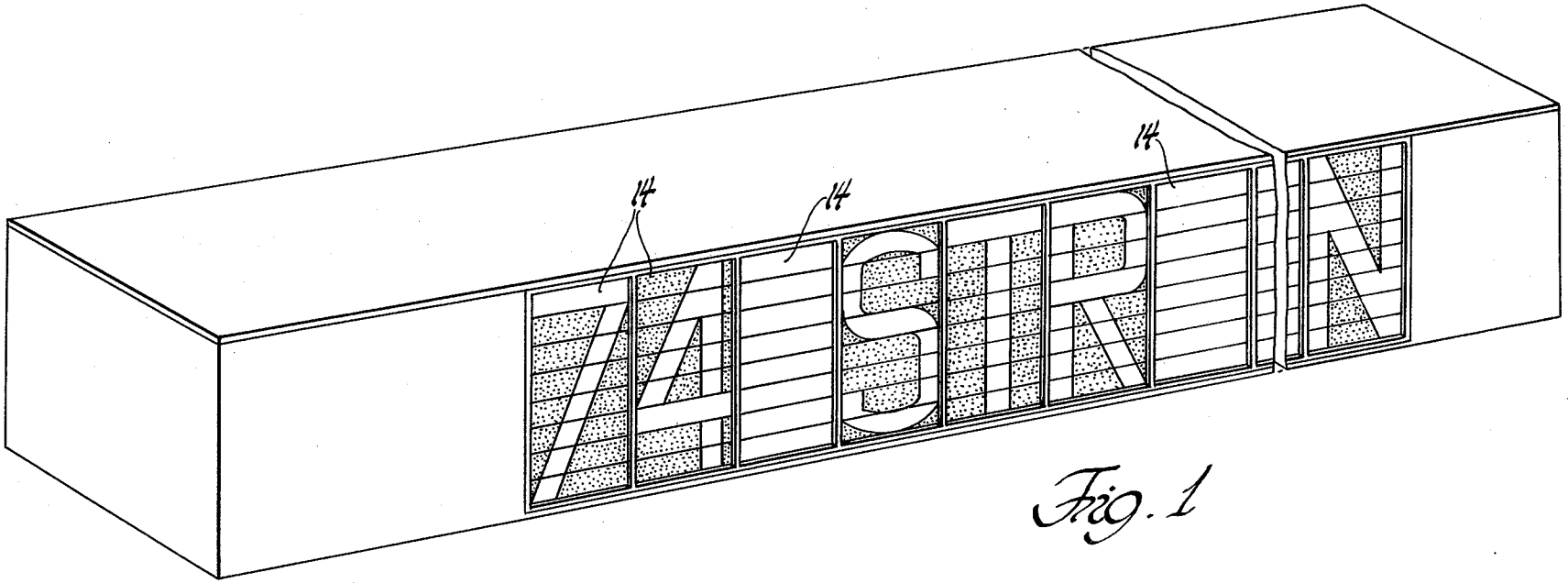
FIG. 1 is a pictorial view of the automatically changeable printed, alphanumeric sign.

Referring now to the drawings, there is shown an illustrative embodiment of the invention in an automatic positioning system for a bus destination sign. The destination sign as shown in FIG. 1 comprises an enclosure or case which is provided with a plurality of windows which display respective alphanumeric characters making up a destination name. A sign module 14 is positioned within the case behind each window so as to present its character display through the window. All of the modules 14 are identical. As will be described below, any character of a set of alphanumeric characters, including punctuation marks, etc. may be displayed in any one of the windows or alternatively the window may be left blank. The sign may be changed to display another destination name by the automatic positioning system of this invention. The vehicle operator is provided with a set of punch cards, each corresponding to a different destination name, and the name displayed by the sign is changed by merely inserting the punch card into a card reader of the automatic control system. The control system causes the modules to be changed individually but concurrently and the changing of the sign is accomplished in a very short time.

Figure 2:
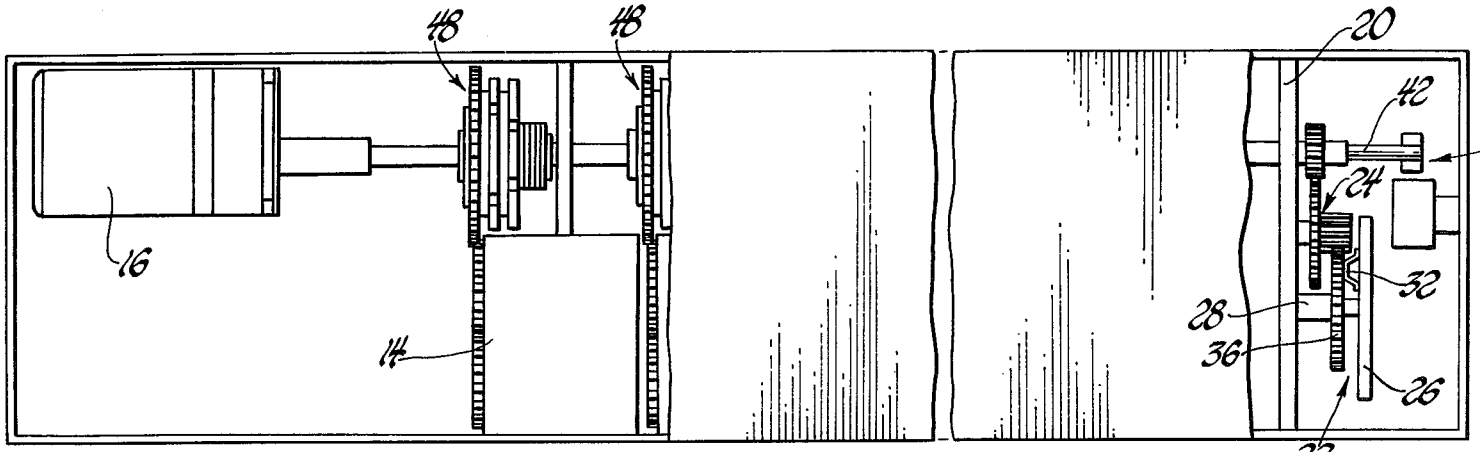
FIG. 2 is a plan view of the sign with portions of the cover removed.

As shown in FIG. 2, the destination sign comprises a reversible electric motor 16 mounted in one end of the case and having an elongated output shaft 18 extending to the other end of the case and through a bulkhead 20. A shaft position encoder in the form of a commutator 22 is driven by the shaft 18 through a gear train 24 which provides a desired speed reduction, as will be discussed below.

It is noted that the commutator 22 comprises a segment board 26 which is stationary by reason of mounting upon a fixed post 28 extending from the bulkhead 20. The commutator also includes a brush 32 mounted upon the face of a gear 36 which is rotatably mounted on the post 28. A pulse generator in the form of a magnetic switch 38 is mounted within the case and comprises a permanent magnet armature 42 mounted on the shaft 18 and a switch 44 mounted on the case.

As disclosed in FIG. 2, each of the modules 14 is adapted for actuation by the drive shaft 18 through a positioning clutch 48. As will be described in detail below, each of the clutches is adapted to selectively couple the respective display modules in driven relationship to the shaft and to hold or brake the module to prevent unwanted movement. The positioning clutches 48 are selectively controlled by a clutch control circuit and the motor 16 is energized under the control of a motor control circuit, as will be described subsequently.

DISPLAY MODULES

Figure 3:
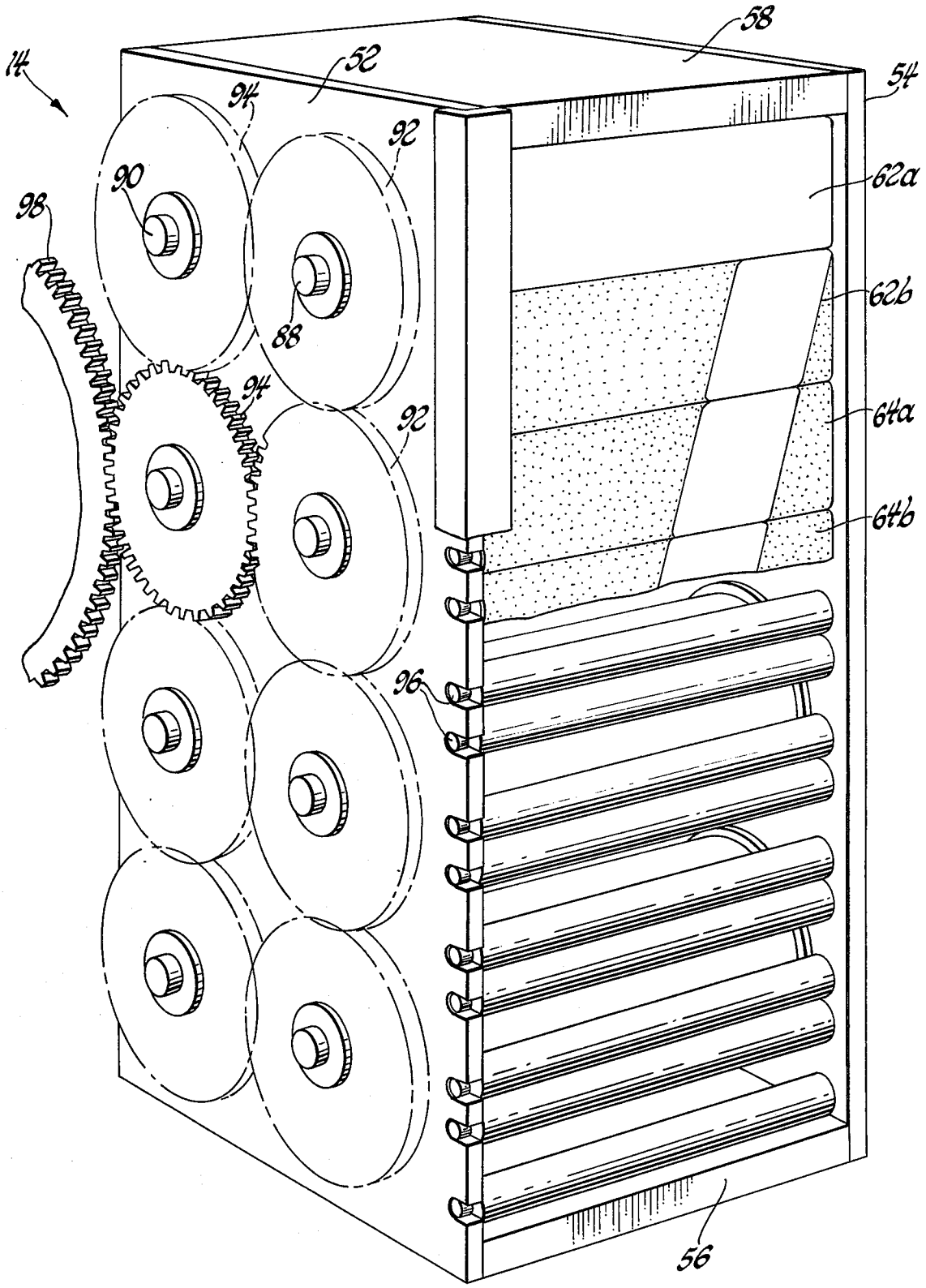
FIG. 3 is a view of one display module.

Each of the display modules 14 is adapted to display selectively any one of a set of alphanumeric characters. All of the modules are identical and will be described with reference to FIGS. 3, 4, 5 and 6. As shown in FIG. 3, the display module 14 comprises a frame which includes a pair of side plates 52 and 54, a bottom plate 56 and a top plate 58. These frame plates define a display window area which is filled with a plurality of tape segments 62*a*, 62*b*, 64*a*, 64*b*, etc. As shown in FIG. 6, the display module comprises plural sets of display tapes 66, 68, 70 and 72. The tape 66 has one end fixed to a driving roller 74 and its other end fixed to a driven or slave roller 76. The display tape 66 intermediate the driving and driven rollers is looped over a first pair of display rollers 78 and 82 and a second pair of display rollers 84 and 86. It is noted that the tape 66 passes from the driving roller 74 over the two display rollers 78 and 82, and thence it is looped around the driving roller and passed over the display rollers 84 and 86 and then extends to the slave roller 76. The portion of the tape extending between the display rollers 78 and 82 is the tape segment 62*a* which is on the front surface of the tape and the portion between display rollers 84 and 86 is the tape segment 62*b* which is on the back surface of the tape.

In the exemplary embodiment of the module, there are four different tapes 66, 68, 70 and 72 each with its respective sets of rollers, the corresponding rollers for all tapes being the same. The roller construction will be described presently.

As will be observed from FIGS. 3 and 6, two different tape segments of each tape are displayed at a time and in adjacent window positions. Tape segment 62*a* bears a character segment which forms the top half of the upper one-quarter of the number "7". Tape segment 62*a* carries the character segment which forms the lower half of the upper one-quarter of the number "7". Tape 68 bears character segments for forming the next lower one-quarter of the character to be displayed and tapes 70 and 72 bear character segments for forming the lower half of the character to be displayed.

Figure 4:
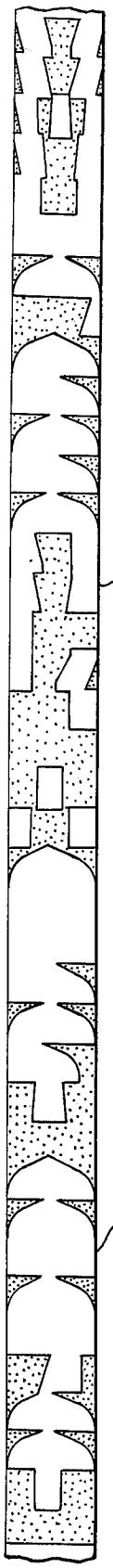
FIG. 4 is the front surface of a display tape.
Figure 5:
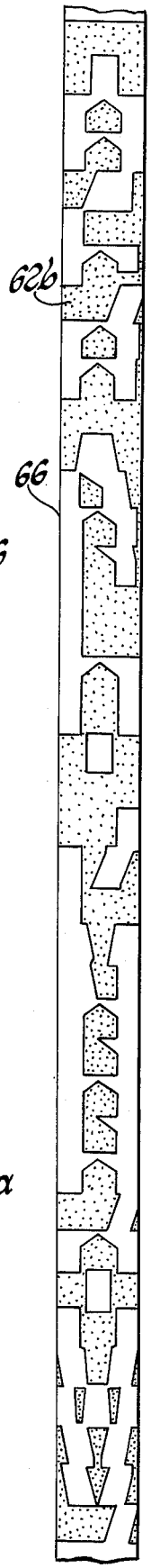
FIG. 5 is the back surface of the display tape shown in FIG. 4.
Figure 6:
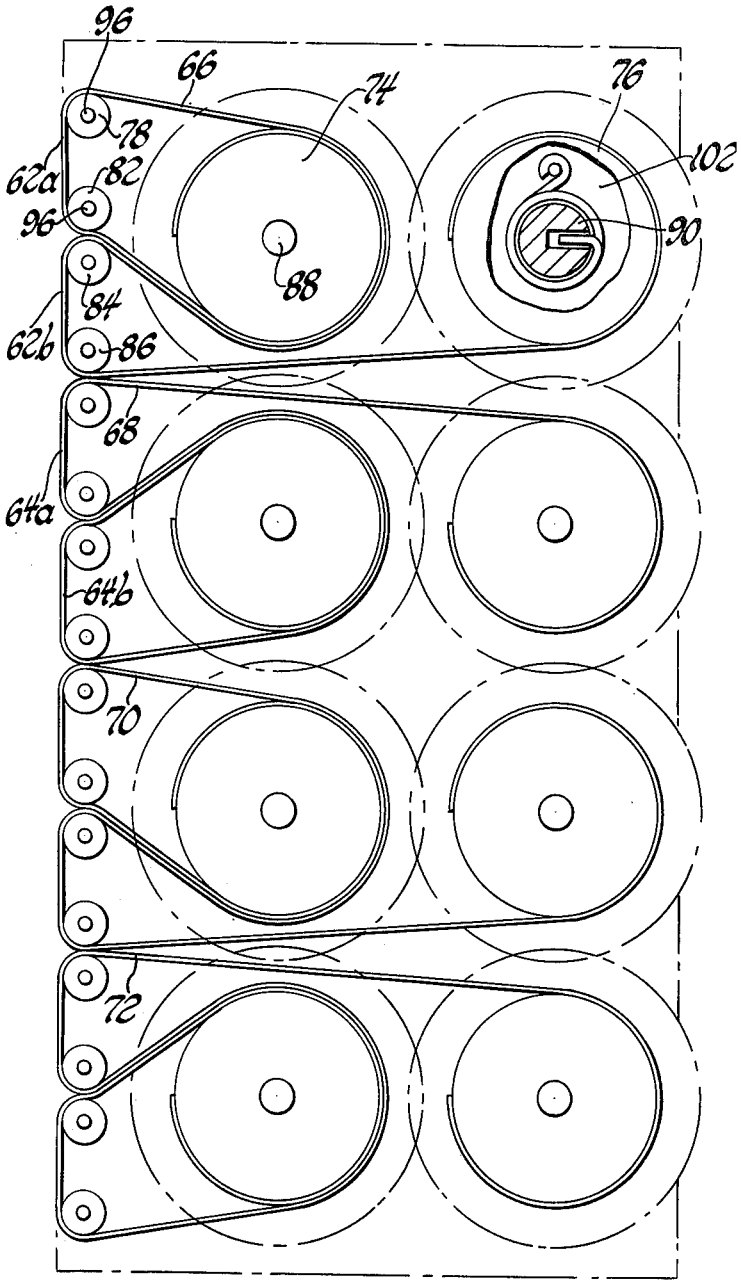
FIG. 6 is a side elevation view of the display module.

The tape 66 is shown in FIGS. 4 and 5. FIG. 4 shows the front surface of the tape which, in the illustrative example, is imprinted with 40 different character segments, each of which represents the upper half of the upper one-quarter of the corresponding forty different characters. FIG. 5 shows the back surface of the tape 66 which is likewise imprinted with forty different character segments. These character segments represent the lower half of the upper one-quarter of the forty different characters. It is noted that tape segment 62*a* on the front surface of the tape 66 is in registry with its window segment when the tape segment 62*b* on the back surface of the tape is in registry with its window segment. The tape 66 as shown in FIG. 5 is turned end-for-end from its position as viewed in FIG. 4 and the set of characters on the back surface if offset along the tape length from the corresponding character segments on the front surface. Thus, the tape segments 62*a* and 62*b* are in relative position on the tape 66 so that they are displayed together and represent the top two respective segments of the number "7".

Each set of driving and slave rollers 74 and 76, respectively, is disposed with the driving roller immediately behind the corresponding pairs of display rollers and the slave roller is immediately behind the driving roller. Each of the driving rollers 74 is provided with a shft 88 which is journaled at opposite ends in the side plates 52 and 54 respectively. Similarly, each of the slave rollers is provided with a shaft 90 which is journaled in the respective side plates 52 and 54. Each driving roller has a gear 92 fixed to its shaft 88 on the outside of the side plate 52. Similarly, each slave roller has a gear 94 fixed to its shaft on the outside of plate 52. The gears 92 and 94 are the same size and are meshed in a driving relationship. It is noted that each driving gear 92 is also meshed with the adjacent driving gear and each slave gear 90 is in mesh with the adjacent slave gear of the ajoining set of rollers. The display rollers 78, 82, 84 and 86 function as guide rollers and are provided with stub shafts 96 which are rotatably mounted in slots in the front edges of the side plates 52 and 54.

The display module is actuated to displace the set of tapes 66, 68, 70 and 72 by means of a gear 98 which is shown in FIG. 3 and will be described in greater detail subsequently. The gear 98 is meshed with the slave gear 94 and this input drive to one of the gears is transmitted to all of the driving rollers and all of the slave rollers since the respective gears are meshed together with each adjoining gear. This drive arrangement causes each driving roller to rotate in the opposite direction from that of the adjoining driving rollers and its associated slave roller. Similarly, each slave roller is rotated in a direction opposite from that of the adjoining slave roller and its associated driving roller. As a display tape is wound from its slave roller onto its driving roller, or vice versa, it will be observed that a given amount of linear payout or uptake of the tape will correspond to a slightly varying amount of angular rotation of the rollers because of the thickness of the layers of tape wound on the rollers. This disparity in the required angular rotation between a driving roller and its associated slave roller is compensated by providing a spring loading in torque for each slave roller. This is provided, as shown in FIG. 6, by connecting the roller shaft 90 to the roller hub 102 by a drive spring 104 with the shaft being otherwise rotatable in the hub. The spring 104 is initially set so as to impart a moderate degree of tension to the tape and suitable stop means is provided to limit the rotation of the shaft 90 relative to the hub 102.

As noted above, the display tapes of the illustrative example are each printed with forty character segments which, taken as a set in each module, are capable of forming all twenty six letters of the alphabet, all ten digits from 0 thru 9, a period (.), a dash (-), a slash (/) and a blank space. The length of the character segments on the tape and the positioning thereof is so related to the effective diameter of the rollers so that rotation of any of the driving rollers or slave rollers by one-quarter turn will displace all of the display tapes to change from one character display to another. It is significant that the display modules are constructed with this relationship so that equal angular increments of displacement of the driving or slave gears will cause the positioning of the tape to change from one correctly aligned character display to another.

It will now be understood that any one of the modules 14 is capable of displaying any one of a set of alphanumeric characters; in the example, each module is capable of displaying forty different alphanumeric characters by setting any one of the driving or slave gears in forty different angular or rotative positions. Each successive rotative position is displaced from the preceding one by equal angular increments.

The display module shown in FIG. 3 is disclosed in copending patent application Ser. No. 637,433 filed on Dec. 3, 1975 which is hereby incorporated by reference into this application.

With reference to FIG. 1, a plurality of modules, for example, a set of twenty display modules, are assembled in a horizontal array to form the changeable sign. In this arrangement any word or number of up to twenty characters can be displayed.

POSITIONING CLUTCHES

As mentioned above, a positioning clutch 48 is adapted to selectively couple and decouple the motor 16 and the respective display module 14. When the drive shaft is driven in the reverse direction, the positioning clutch functions to drive its respective display module until the module is returned to its home position; when the drive shaft is driven in the forward direction, the positioning clutch drives its respective display module forward upon receipt of a command signal and it arrests the module at the selected position. For this purpose, the clutch means preferably includes a mechanical differential gear set.

Figure 7:
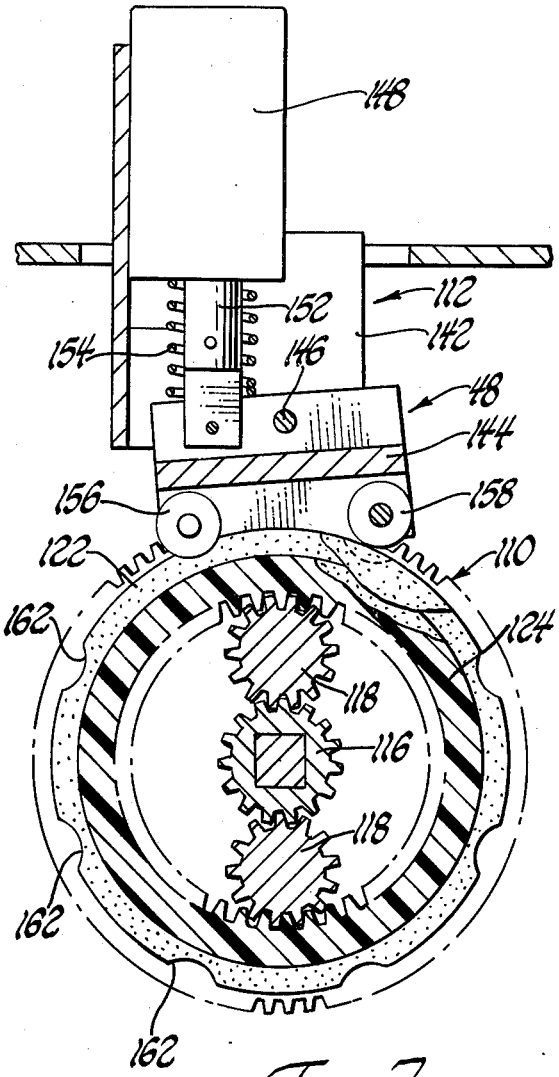
FIG. 7 shows a planetary positioner with a section view taken on lines 7—7 of FIG. 8.
Figure 8:
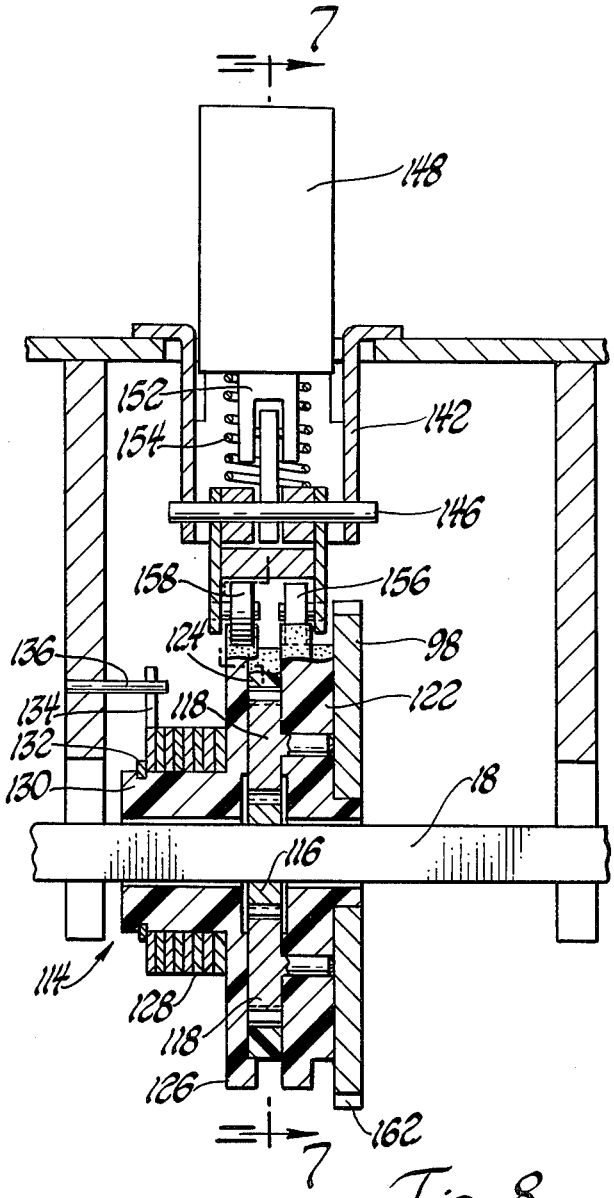
FIG. 8 shows another view of the positioner of FIG. 7.
Figure 10:
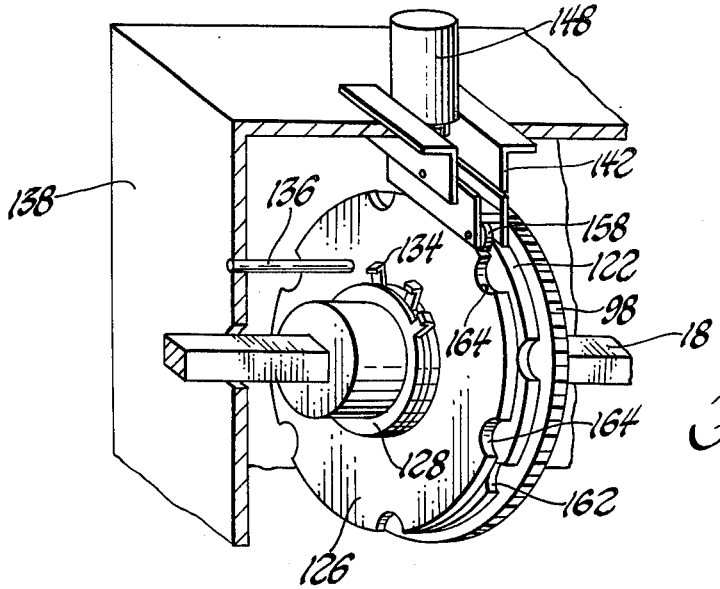
FIG. 10 is a pictorial view of another embodiment of a planetary positioner.
Figure 12:
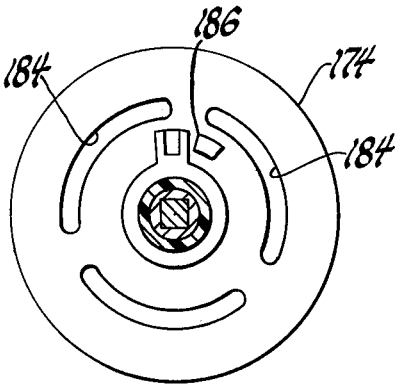
FIG. 12 is a view taken on lines 12—12 of FIG. 11.
Figure 11:
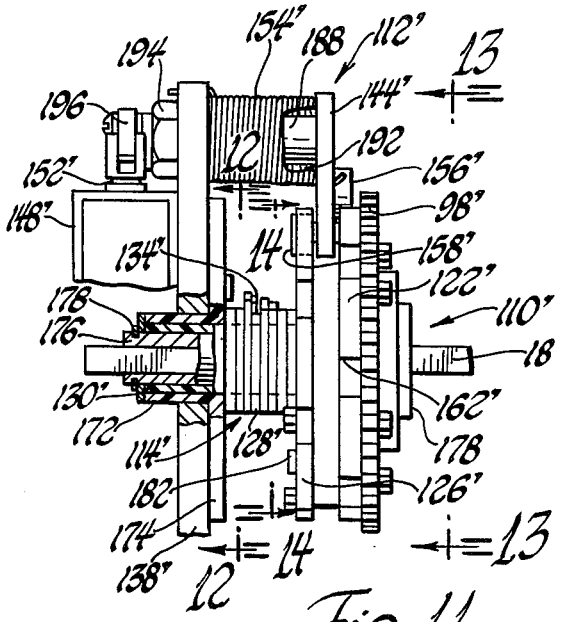
FIG. 11 shows an elevation view of the planetary position shown in FIG. 10.
Figure 13:
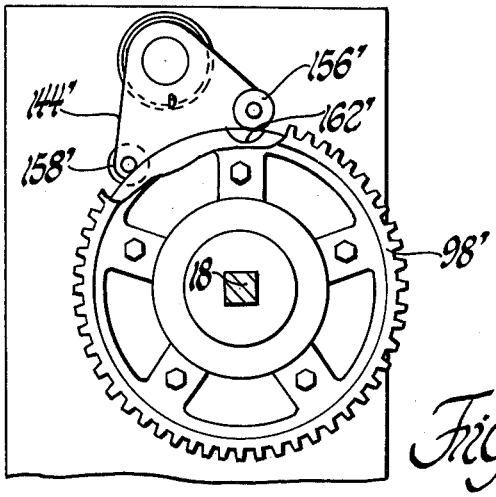
FIG. 13 is a view taken on lines 13—13 of FIG. 11.
Figure 14:
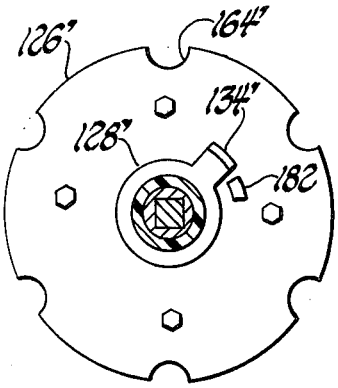
FIG. 14 is a view taken on lines 14—14 of FIG. 11.

The positioning clutch 48 will now be described with reference to FIGS. 7, 8 and 10. In general, it comprises a planetary gear set 110 with a primary operating member or latch 112 and secondary operating member or variable limit stop 114.

The planetary gear set 110 comprises a sun gear 116 which serves as an input member and is adapted to receive the drive shaft 18 in driving engagement. It is noted that the drive shaft, in the examplary embodiment, is a square shaft and extends through a square opening in the sun gear 116. The planetary gear set also includes a pair of planet gears 118 which are rotatably mounted in a planet carrier 122. The planet carrier 122 serves as an output member and is free to rotate with respect to the shaft 18 and is carried by the planet gears 118. The planet carrier 122 supports the output or driving gear 98 which is nonrotatably secured to the carrier 122. An internal ring gear 124 meshes with the planet gears 118 and is supported thereby for rotation with respect to the shaft 18 about the axis thereof. The internal ring gear serves as a control member and supports a ring gear carrier 126 which is rotatable therewith relative to the shaft 18. The driving gear 98 is meshed with one of the slave gears 94 on the respective display module and drives the gears of the module. The ring gear carrier 126 carries the variable limit stop means 114.

It will be understood that the sun gear 116 serves as the input to the planetary gear set and that the planet carrier 122 serves as the output for the purpose of transmitting power through the device. The ring gear carrier 126 serves as the control member for the purpose of coupling or decoupling the shaft 18 to the driving gear 98. In the exemplary embodiment of the planetary gear set, the sun gear 116 has a pitch diameter one-third of that of the ring gear 124. Accordingly, if the drive shaft 18 is driven and the ring gear is held stationary the planet carrier 122 turns in the same direction as the drive shaft at one-fourth the speed. If the planet carrier is held stationary, the rotation of the drive shaft causes the ring gear 124 to turn in the opposite direction at one-third the speed of the drive shaft. In order to selectively hold the planet carrier 122 or the ring gear, which is mounted in the ring gear carrier 126, the latch means 112 is provided. The latch means comprises a support member 142 and a latch body 144 which is mounted by a pivot pin 146 on the support member. The latch means further includes an actuator in the form of a solenoid 148 mounted upon the support member 142 and having a reciprocable armature 152 connected with the latch body 144 on one side of the pivot pin 146. The armature is normally extended by the force of a bias spring 154 disposed over the armature between the solenoid and the latch member. The latch member 144 carries a roller 156 on one side of the pivot pin 146 and in alignment with the rim of the planet carrier 122. The latch member 144 carries another roller 158 on the other side of the pivot pin 146 and in alignment with the rim of the ring gear carrier 126. The planet carrier 122 is provided with a plurality of semi-circular notches 162 in the periphery of its rim, each notch being adapted to accept the rim of the roller 156 when the armature of the latch means is extended. Similarly, the rim of the ring gear carrier 126 is provided with a plurality of circular notches 164, each of which is adapted to accept the rim of the roller 158 when the armature of the latch member 144 is retracted.

The planet carrier 122 and the ring gear carrier 126 both rotate about the axis of the drive shaft 18 but in opposite directions. The latch body 144 is movable about the pivot pin 146 so that when the solenoid 148 is deenergized and the armature 152 is extended, the roller 156 engages the rim of the planet carrier 122 and will seat in one of the notches 162. In this position the roller 158 is clear of the rim of the ring gear carrier 126. Accordingly, the planet carrier and hence the output gear 98 is braked or held stationary. In this condition counterclockwise rotation of the shaft 18 (as viewed from the left side of FIG. 8) causes clockwise rotation of the ring gear carrier 126. When the solenoid 148 is energized and the armature 152 is retracted thereby, the roller 158 is urged into engagement with the rim of the ring gear carrier 126 and wll seat in one of the notches 164. This will cause the ring gear to be braked or held stationary and the roller 156 will be clear of the planet carrier 122, leaving it free to rotate. In this condition, clockwise rotation of the drive shaft 18 (as viewed from the left end in FIG. 8) will cause clockwise rotation of the planet carrier and hence the output gear 98.

As discussed above, the driving rollers 74 and the slave rollers 76, in the exemplary embodiment of the display modules, are dimensioned relative to the linear array of the character segments on the tapes so that the rollers turn one-fourth of a revolution for each character segment. The output gear 98 which drives the slave gear 94 is chosen to be twice the diameter of the slave gear and therefore a planet carrier 122 is provided with eight detent notches 158 equally spaced around its periphery. Since the drive shaft 18 will turn four times as fast as the planet carrier 122, one-half revolution of the drive shaft is equivalent to one character segment, i.e. one-half revolution of the shaft will advance the display from one character to the next. The ring gear 124 turns three times as fast as the drive shaft 18 and the ring gear carrier 126 is therefore provided with six detent notches 164 which are equally spaced around its periphery.

The actuation of the positioning clutch 48 by the primary operating member or latch means 112 has been described; now, the actuation by the secondary operating member or variable limit to stop 114 will be described.

The limit stop means includes a set of dog washers 128, each of which is rotatably mounted upon a hub 130 on the carrier 126. The stack of washers is axially retained by a stop ring 132 in the hub. Each of the dog washers is provided with a dog element 134 (see FIG. 10) which has a radial portion extending beyond the circumference of the washer and an axial portion extending laterally of one face of the washer. The dog element of each washer is adapted to engage the dog element of the adjacent washer upon relative rotation of the washers. The first washer, i.e. the washer immediately adjacent the carrier 126 is engageable by a drive dog (not shown) on the carrier and rotatable therewith. Accordingly, upon rotation of the carrier the first dog washer will pick up the second dog washer during the first revolution of the first, the second dog washer will pick up the third dog washer during the first revolution of the second, and so on until all of the dog washers are moving in unison. A stop element 136 is fixedly mounted in a frame member 138 in a position such that it is engaged by the dog element 134 on the last dog washer during the first revolution of the last washer.

The function of the limit stop means 114 is to hold the ring gear carrier against clockwise rotation (as viewed from the left end of the shaft in FIG. 8) after a variable but pre-set number of clockwise revolutions as the shaft 18 is being driven counterclockwise to reset the display devices to the home position. For this purpose, the stack of dog washers 128 is initially set with the respective display in the home position so that all washers in the stack are rotated in a clockwise direction (as viewed from the left end of the shaft in FIG. 8) to the limiting position, i.e. with all dog elements in tight engagement. When the shaft 18 is driven clockwise during the positioning cycle of the display devices there is a first phase of the cycle in which the latch means 112 is not energized and accordingly the roller 156 is seated in a detent notch 162 of the planet carrier 122 thereby holding it against rotation. During this portion of the cycle, the ring gear carrier 126 is free to rotate and is driven in a counterclockwise direction and the stack of dog washers 128 is "unwound". When the latch means 112 is energized the roller 158 is urged against the rim of the ring gear carrier and will drop into one of the detent notches 164 to stop the rotation of the ring gear carrier. At the same time the roller 156 is withdrawn from the detent notch in the planet gear carrier 122 and it is allowed to rotate. In this phase of the positioning cycle, with the shaft rotating in a clockwise direction, the planet gear carrier also rotates in a clockwise direction and thus displaces the respective display module. As will be understood from the description below, the positioning cycle may include a repetition of the operation just described, i.e. deenergization of the latch means 112 and consequent rotation of the ring gear carrier 126 in the counterclockwise direction with further unwinding of the stack of dog washers followed by energization of the latch means with the consequent rotation of the planet gear carrier 122 in a clockwise direction. At the end of the positoning cycle, the shaft 18 will have been rotated in a clockwise direction through a fixed number of revolutions. During a part of this fixed number of revolutions the ring gear carrier 126 will be driven and the planet gear carrier will be held stationary. The revolutions of the ring gear carrier are counted and memorized by the unwinding of the dog washer stack and the number of revolutions of the planet gear carrier is transmitted through the driving gear 98 to the display module to displace it to its selected position.

When the sign is to be changed to present a new display, the reset cycle is initiated. This causes the shaft to be driven in a counterclockwise direction (as viewed from the left end in FIG. 8). When this happens the latch means 112 is deenergized and the roller 156 is seated in one of the detent notches 162 of the planet gear carrier 122. In this condition the ring gear carrier 126 will be rotated clockwise and the rotation will continue until the dog washer stack 128 is wound up tight with the dog element 134 engaging the stop pin 136. The clockwise rotation of the ring gear carrier 126 is stopped with the carrier in position so that one of the detent notches 164 is opposite the latch roller 158. With the ring gear carrier 126 held against rotation by the limit stop means 114, torque will be applied to the planet gear carrier 122 in a counterclockwise direction. This torque acting against the latch roller 156 and the bias spring 154 will pivot the latch body 144 since the roller 158 is aligned with one of the detent notches 164. This counterclockwise rotation of the planet gear carrier 122 causes the latch body 144 to ratchet. This rotation of the planet gear carrier 122, and hence the drive gear 98, continues until the display module is reset to its home position. In this position the positioning clutch 48 is in readiness for the positoning cycle which is commenced with reversal of the motor, the operation of which will be discussed below. With the display module at the home position, the drive shaft 18 drives clockwise (as viewed fromthe left end in FIG. 8) and the ring gear carrier 126 is rotated counterclockwise since the planet carrier 122 is held stationary by the latch means until the solenoid 148 is energized. When the solenoid is energized it pulls the latch roller 158 into the next detent notch on the ring gear carrier 122 to turn clockwise to advance the display module away from the home position. When the solenoid is deenergized the bias spring 154 will pivot the latch body so that the latch roller 156 will drop into the first detent notch in the planet carrier 122 to stop the movement of the display at the detented position. If the solenoid is again energized the latch body will pivot again at the next detent notch in the ring gear carrier 126 and the planet gear carrier will be driven to further advance the display module. Since the starts and stops of the planet gear carrier can only occur at detent notch positions and since these are spaced to correspond to whole character segments, the movements of the display module can occur only in increments equal to the whole character increments. Since the latch body 144 can only be pivoted when both latch rollers 156 and 158 are aligned with a detent notch, the electrical command signal to activate the change can be applied at any time in advance of the alignment of the latch rollers and detent notches and will be effective only upon such alignment.

ALTERNATIVE EMBODIMENT OF POSITIONING CLUTCHES

A modification of the positioning clutch which represents a preferred embodiment thereof is shown in FIGS. 11, 12, 13 and 14. In this embodiment the planetary gear set 110' is the same as its counterpart 110 shown in FIGS. 7, 8 and 10; the primary operating member or latch 112' and the secondary operating member or variable limit stop 114' differs somewhat from their counterparts and will be described briefly at this point. For convenience, the parts in this embodiment which are the same as in FIG. 10 are designated by the same reference characters, except that a primy symbol is added. It is noted that the planetary gear set 110' has a planet gear carrier 122' which carries the output gear 98'. The ring gear carrier 126' has an elongated hub 130' which supports the stack of dog washers 128' and which extends through the support plate 138' in a bushing 172 integral with an adjusting plate 174 which will be described below. A drive shaft sleeve 176 has an integral flange 178 at the right hand end which is seated against the face of the hub of the planet carrier 122'. The sleeve 176 extends from the flange 178 through the hub 130' and protrudes beyond the bushing 172 and is secured in place by a washer and snap ring 178. This arrangement mounts the planetary gear set 110' along with the variable limit stop means 114' on the mounting plate 138'. The sun gear of the planetary gear set 110' (not shown) is nonrotatably mounted on the shaft sleeve 176 and the square drive shaft 18 extends through the sleeve in driving engagement with the sleeve.

Reverting now to the variable limit stop means 114', it is noted that the first dog washer 128' adjacent the ring gear carrier 126 is drivingly engaged by a lug 182 on the carrier. The adjusting plate 174, alluded to above, is mounted upon the support plate 138' and secured thereto for angular adjustment by means of bolts extending through arcuate slots 184. The adjusting plate 174 is provided with a stop lug 186 which coacts with the last of the dog washers 128'. The adjusting plate 174 is angularly positioned so that the stack of dog washers 128' is wound up tight between the driving lug 182 and the stop lug 186 when the shaft is in the home position. In the wound up condition of the dog washers each dog element 134' is in engagement with the dog element on the adjacent washer so that there is no rotative lost motion between the first dog washer and the last dog washer.

The latch means 112' comprises a latch body 144' having an integral pivot shaft 188 which extends through a mounting sleeve 192 which is mounted on the support plate 138' by a threaded nut 194. The end of the pivot shaft 188 is fitted with a crank arm 196 which, in turn, is connected with the reciprocable armature 152' of the solenoid 148'. The solenoid 148' is mounted on the support plate 138'. The latch body 144' carries a latch roller 156' adapted to seat in the detent notches 162' on the planet carrier 122'. The latch body 144' also carries a latch roller 158' adapted to seat in the detent notches 164' of the ring gear carrier 126'. The latch body 144' is biased toward engagement of the roller 156' with the planetary carrier 122' by a helical torsion spring 154' extending between the support plate 138' and the latch body 144'.

The operation of the positioning clutch of FIGS. 11, 12, 13 and 14 is the same as that described with reference to the embodiment of FIGS. 7, 8 and 10.

THE SHAFT POSITION ENCODER

Figure 9:
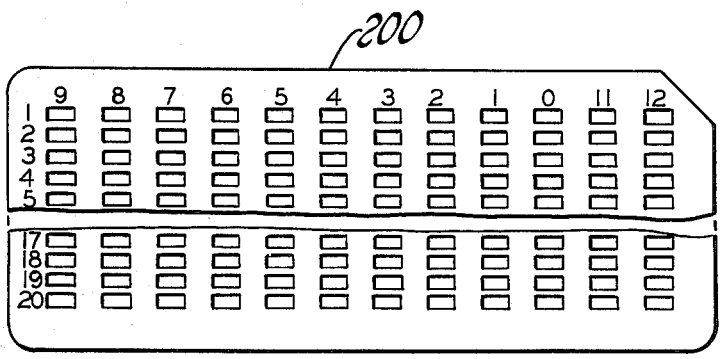
FIG. 9 shows a typical punch card.
Figure 16:
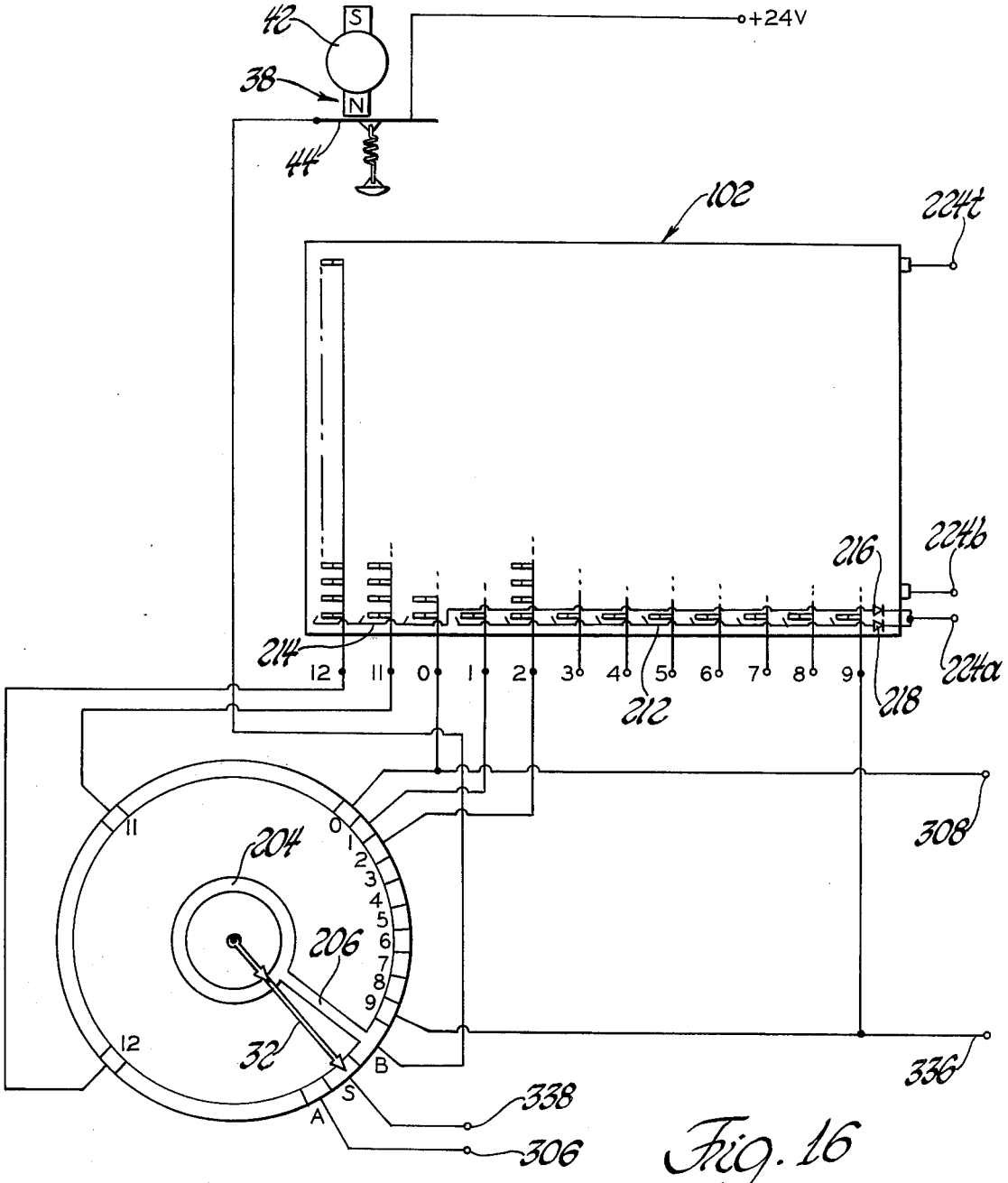
FIG. 16 is a schematic of a portion of the control circuit.

As mentioned above in connection with FIG. 2, the shaft position encoder takes the form of a commutator 22 which is shown diagrammatically in FIG. 16. The commutator is adapted to coact with a selector means in the form of a card reader for coded punch cards. The card reader and the commutator, in the exemplary embodiment, are adapted for use with the well known Hollerith code. The commutator functions to distribute pulses to the card reader and also to provide signals to the motor control means and the clutch control means which will be described subsequently. The Hollerith code is a "2 out of 12" code system; a punch card 200, as shown in FIG. 9, has twelve rows of punch positions numbered 0 through 9, 11 and 12. A column, taken across the 12 rows, will have holes at 2 punch positions and holds the code representing the desired character or command position for one display module. There are as many columns as there are display modules to be controlled and hence, the punch card of FIG. 9 will have 20 columns for the sign of FIG. 1 which has 20 different display modules 14. As will appear below, a different segment of the commutator is connected with a corresponding row in the card reader and each column of the card reader is connected to a clutch control means for the respective display module.

As shown in FIG. 16, the commutator 22 comprises plural conductive segments which are designated at 0 through 9, 11, 12 and A, S and B. The conductive segments are insulated from each other in a conventional manner. A slip ring 204 is an annular conductive path and is connected by a conductor 206 to the segment B. The commutator brush 32 bridges the slip ring 204 and one of the conductive segments 0 through 9 11, 12, A, S, or B, depending upon the angular position of the brush. The brush 32 as described above, is geared to the drive shaft 18 so that a full excursion of the shaft during a positioning cycle turns the brush less than one full revolution. Thus the commutator brush always indicates the shaft position without ambiguity.

Voltage pulses are supplied to the commutator brush for distribution sequentially through the commutator segments according to the brush position. For this purpose, the magnetic switch 44 which was mentioned in connection with FIG. 2, is actuated by the permanent magnet 42 mounted on the shaft 18. As shown diagrammatically in FIG. 16, the switch 44 is serially connected between a source of DC voltage and the commutator segment B. The permanent magnet armature 42 coacts with the switch 44 with the motor going in the forward direction, i.e. with the commutator brush rotating counterclockwise, as seen in FIG. 16. The magnetic switch supplies one pulse for each ½ revolution of the shaft and hence, for each character segment. Each pulse occurs during the traverse of a commutator segment, and the distribution of the pulses will be described below.

POSITION SELECTOR MEANS

The selector means, as mentioned above, takes the form of a conventional card reader with the cards punched according to the Hollerith code in the illustrative embodiment. The punch card reader 202, as represented diagrammatically in FIGS. 15 and 16, comprises 12 rows of electrical contact elements 208 with 20 contact elements in each row. The rows in the card reader are designated 0 through 9, 11 and 12 and the contact elements in the respective rows are all connected by a conductor to the corresponding commutator segment. The contact elements 208 are arranged in columns with each column corresponding to a display module to be controlled. Each column is provided with a bus 212 which overlies the contact elements in rows 1 through 9 and a bus 214 which overlies the contact elements in rows 0, 11 and 12. When a punch card is inserted into the card reader the matrix of the columns and rows corresponds in position with the columns and rows of the card reader. Hence, when a hole in the card in column 1 coincides with one of the contact elements 208 in rows 1 through 9 a conductive path is completed from the contact element to the bus 212. Similarly, when a hole location coincides with one of the contact elements 208 in row 0, 11 or 12, a conductive path is completed to the bus 214. The buses 212 and 214 are connected electrically through respective isolating diodes 216 and 218 to the respective clutch control means which will be described subsequently. It will now be appreciated that a different word or name to be displayed by the sign is represented in coded form by a punch card. For this purpose, each column of the punch card corresponds with a given display module of the sign. The alphanumeric character for the given module is represented by the location of the holes punched in particular columns. Using the Hollerith code, as mentioned above, there are two holes in each column and there are enough different positional combinations of holes in each column to encode 40 different characters.

Figure 15:
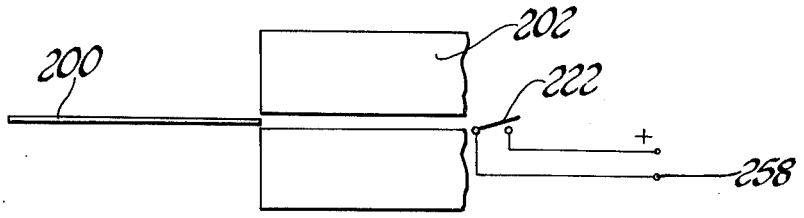
FIG. 15 shows a portion of a card reader.

When the punch card 200 is inserted into the card reader 102, as depicted in FIG. 15, it engages a switch actuator and closes a switch 222. As will be discussed below in connection with the motor control circuit, closure of the switch 222 supplies a logic level voltage to the motor control circuit and causes the motor to run in the reverse direction to drive the display modules to their respective home positions. In the home position of the display modules the drive shaft 18 is in a rotative position so that the commutator brush 32 is in engagement with commutator segment number 9. With the motor in reverse the drive shaft is rotated in a clockwise direction and the commutator brush 32 is rotated in a clockwise direction. When the brush 32 engages the segment number 9 a logic signal to the motor control system causes the motor to reverse and run in its forward direction, thus initiating the positioning cycle. The brush 32 is now rotated in a counterclockwise direction and the voltage pulses from the magnetic switch 38 are distributed sequentially through each of the commutator segments to the rows of contacts 208. It is noted that the scanning sequence of the card reader rows is 9 through 0, 11, 12, A and S. A pulse from the magnetic switch 38 is supplied through the commutator brush for each segment and, the pulse for the number 7 segment will go to the number 7 row of the card reader. If there is a hole in the card at row number 7 in a given column, a pulse will be applied from the row contact 208 to the bus 212. Similarly, if there is a second hole, for example, in row number 11 in the same given column, the pulse applied through the commutator brush 32 when it reaches segment number 11 will be applied to bus 214. The pulse on bus 212 is applied through its respective diode 216 to the conductor 224*a* and the pulse on the bus 214 is applied through its respective diode 218 to the conductor 224*a*. The conductor 224*a* thus corresponds to column 1 of the card reader and also corresponds to the first display module of the sign. The conductor 224*a* is connected to the clutch control means of the first display module, as will be discussed below. A different conductor 224*a*, 224*b*, 224*c*, etc. through 224*t*, is provided for each column of the card reader and hence corresponds with a different display module. The conductors 224*a* through 224*t* are connected respectively with the clutch control means of the respective display modules.

CLUTCH CONTROL MEANS

Figure 18:
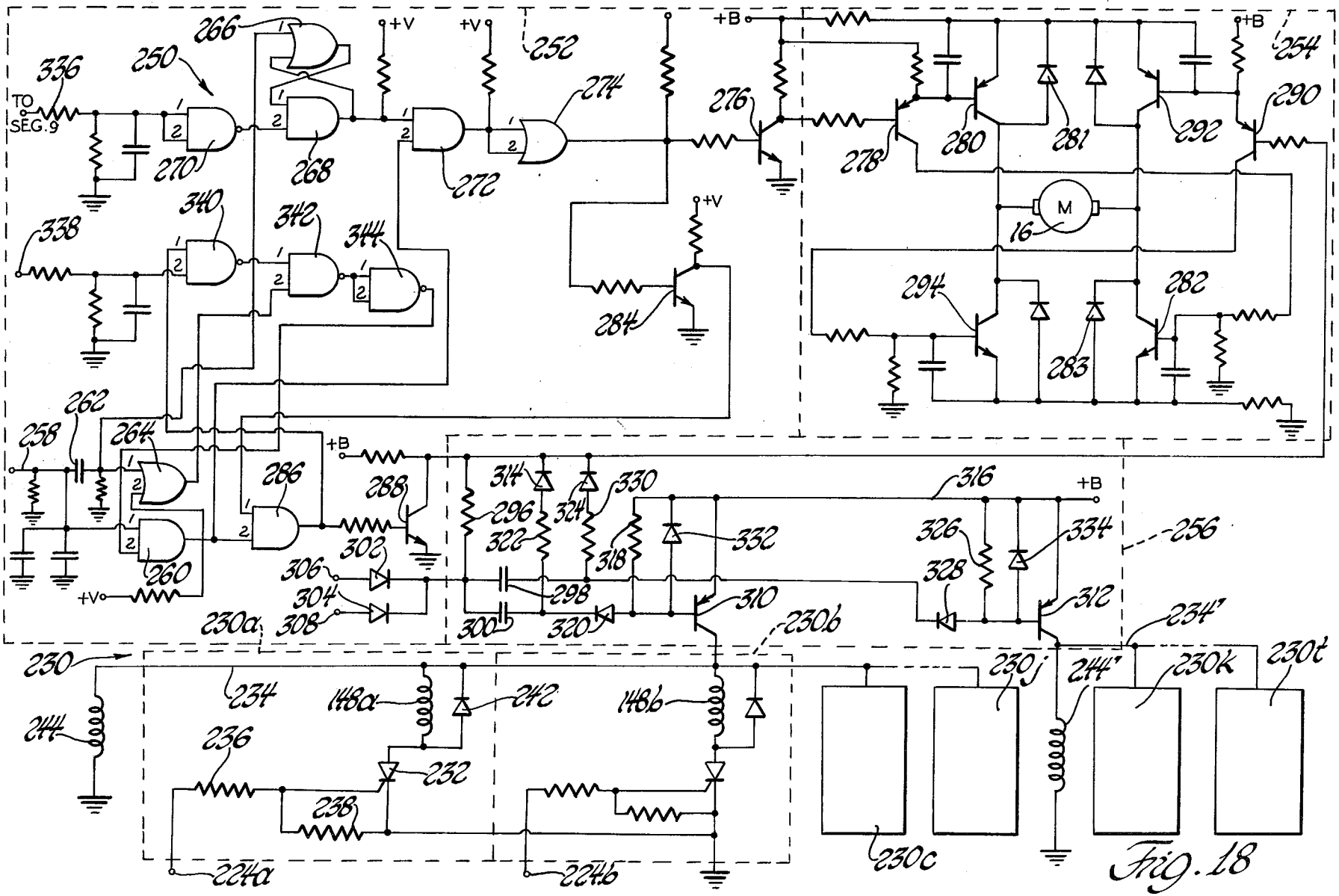
FIG. 18 is a schematic diagram of another portion of the control circuit.

The clutch control means 230 is shown schematically in FIG. 18. The clutch control means comprises circuits 230*a*, 230*b*, etc. through 230*t*. Each of these circuits is identical to the other and corresponds to a given column of the punch card reader and hence with a given display module of the sign. The clutch control circuits are divided into two groups, the first group including circuits 230*a* through 230*j* and the second group comprising circuits 230*k* through 230*t*.

The purpose of each of the clutch control circuits is to control the positioning clutch of the respective display module in accordance with the command signals produced by the card reader 202. For this purpose, the solenoid winding of a given positioning clutch is connected in the respective clutch control circuit. As shown in FIG. 18, clutch control circuit 230*a* includes solenoid winding 148*a* of the positioning clutch of the first display module, circuit 230*b* includes solenoid winding 148*b* and so on. Clutch control circuit 230*a* comprises a silicon controlled rectifier (SCR) 232 connected in series, anode to cathode, with the solenoid winding 148 between a supply voltage conductor 23 and ground. The gate of the SCR is connected with the conductor 224*a* through voltage divider resistors 236 and 238. Thus the control signal for the clutch control circuit 230*a* is derived from the card reader 202 at its output terminal for the first column which is conductor 224*a*, as discussed above. A protective diode 242 is connected in parallel with the solenoid winding 148. A commutating coil 244 for the SCRs of the first group of control circuits is connected across the supply conductor 234.

All of the clutch control circuits are the same as circuit 230*a*. The respective clutch control circuits receive control signals from the respective conductors 224*a*, 224*b*, etc. of the card reader 202. The clutch control circuits 230*k* through 230*t* of the second group are connected with a supply voltage conductor 234'. These circuits are provided with a commutating coil 244'.

MOTOR CONTROL MEANS

The motor control means 250 is shown schematically in FIG. 18. The function of the motor control means is to control the energization of the motor so that it drives the display modules in the reset cycle to the home position for each module and thereupon drives the modules in the positioning cycle during which they are positioned selectively by the positioning clutches and the clutch control means. The reset cycle is initiated by the insertion of a punch card into the card reader and the positioning cycle is initiated upon termination of the reset cycle. The commutator brush 32 is always positioned in contact with commutator segment S at the end of the positioning cycle and it remains there until another punch card is inserted in the card reader to select a new sign. This is the "rest" position for the commutator brush and for the drive shaft. In general, the motor control means comprises a control logic circuit 252, a motor reversing circuit 254 for the drive motor 16 and a supply voltage control circuit 256.

The motor control means is implemented in digital logic circuits and to avoid repetitious description, the circuits and the operation will be described together.

RESET CYCLE

When it is desired to change the name displayed by the sign, a punch card is selected which is encoded with the desired name and inserted into the card reader. This closes the switch 222 (see FIG. 15) and a positive voltage is applied by a conductor 258 to one input of the control logic circuit 252. The positive voltage on the conductor 258 applies a steady positive voltage on input 1 of an AND circuit 260. The positive voltage on the conductor 258 is coupled through a capacitor 262 to input 1 of an OR gate 264. At this time a true (positive) signa is applied to input 2 of AND gate 260 and hence the output thereof is true. The output of the OR gate 264 goes true due to the pulse through the capacitor 262 on input 1; it remains true because the output of the AND gate 260 is applied to input 2. The pulse through capacitor 262 is also applied to input 1 of an OR gate 266 causing the output thereof to become true. The output of the OR gate 266 is applied to input 1 of an AND gate 268. This AND gate has its input 2 connected with the output of a NAND gate 270 which has both inputs 1 and 2 connected through an RC network to segment 9 of the commutator. Hence, at this time, the state of the NAND gate 270 is true and the AND gate 268 is switched from false to true. The output of AND gate 268 is connected to input 1 of an AND gate 272 which receives a true signal from AND gate 260 on its input 2. Accordingly, AND gate 272 is in a true state and its output is supplied to inputs 1 and 2 of an OR gate 274 which is switched to a true state. The output of the OR gate 274 is coupled to the input or base of a preamplifier transistor 276. With the OR gate 274 in a true state, the transistor 276 is turned on and its collector goes from a high state to a low state. This causes a transistor 278 to be turned on since its base is coupled to the collector of transistor 276 and its emitter is connected with a supply voltage. When transistor 278 is turned on the motor 216 is energized for reverse rotation through a power transistor 280 and a power transistor 282. Transistors 280 and 282 are provided with protective diodes 281 and 283 respectively. At the same time, the output of the OR gate 274 in its true state turns on an inverter transistor 284 and the collector thereof goes from a high state to a low state. The collector is connected to input 1 of an AND gate 286 which has its input 2 connected with the output of the AND gate 260. The false input to the gate 286 produces a false output which is applied to the base of transistor 288. Transistor 288 is thus in an off condition and the collector thereof is held at the positive supply voltage. This high voltage on the collector of transistor 228 is applied to the base of a transistor 290 keeping it turned off. The emitter of transistor 290 is connected to the base of a power transistor 292 keeping it turned off and the collector of transistor 290 is connected with the base of a power transistor 294 keeping it turned off. The transistor 292 and 294 are provided with protective diodes 293 and 295, respectively.

The control logic circuit 25, in addition to being connected with the motor reversing circuit 254 is connected with the supply voltage control circuit 256. The circuit 256 controls the supply voltage for the clutch control means 230. For this purpose, the collector of transistor 288 is connected through a resistor 296 to capacitors 298 and 300 thus putting a positive voltage on these capacitors. This prevents these capacitors from drawing any charging current through a pair of input diodes 302 and 304 thereby disabling input signal paths through conductors 306 and 308 to a pair of transistors 310 and 312.

The transistor 310 is the power transistor for supplying voltage to the supply conductor 234 and thence to the solenoid windings of the clutch control circuits 230*a* through 230*j*. Similarly, the transistor 312 is the power transistor for supplying voltage to the supply conductor 234' and the clutch control circuits 230*k* through 230*t*. When the collector of transistor 288 is in its high state, as during motor reversal, the positive voltage thereof is applied to the cathode of a diode 314. This results in holding the base of transistor 310 at the same potential as its emitter which is connected with a supply voltage conductor 316. This follows because the voltage on the cathode of the diode 314 prevents conduction from the supply voltage conductor 316 through a resistor 318, a diode 320 and a resistor 322 which is connected with the anode of the diode 314. Similarly, the positive voltage of the collector of transistor 288 is applied to the cathode of a diode 324 resulting in the holding of the base of transistor 312 at the same potential as its emitter. This follows because the diode 324 blocks the current path from the supply conductor 316 through a resistor 326, a diode 328 and a resistor 330 to the anode of the diode 324. Thus, transistors 310 and 312 are held in the off condition so long as the transistor 288 is off. Furthermore, as discussed above, the input signal paths 306 and 308 are disabled during the reset cycle. This arrangement avoids any actuation of the positioning clutches during the reset cycle which might cause false positioning of a display module. A protective diode 332 is connected across the base and emitter of transistor 310 and a protective diode 334 is connected across the base and emitter of transistor 312.

The motor 16 continues to be energized in the reverse direction until the commutator brush engages the number 9 segment; this is the home position for the display modules, each of which displays a blank in this position. A signal pulse from the magnetic switch 38 through the number 9 segment is applied through a conductor 336 (see FIG. 16) to the input 1 and 2 of the NAND gate 270 (see FIG. 18). This changes the state of the NAND gate from true to false and, in turn, changes the state of NOR gate 266 and the state of AND gate 268 from true to false. This causes AND gate 272 to go from true to false and consequently OR gate 274 goes from true to false. This turns off transistors 276 and 278, which in turn shuts off the power transistors 280 and 282 which stops the reverse rotation of the motor.

The switching of the OR gate 274 from true to false, as a result of the pulse from the number 9 segment, causes the inverter transistor 284 to turn off. Thus the collector of this transistor goes high and causes the state of AND gate 286 to change from false to true. This turns on the transistor 288 and causes its collector voltage to go from high to low. As a result the driver transistor 290 turns on and this causes the power transistor 292 and the power transistor 294 to turn on and energize a motor 16 in the forward direction.

The turning on of the transistor 288 also removes the blocking voltage from the cathodes of diodes 314 and 324. Consequently, the transistor 310 draws input current from supply conductor 316 through its emitter to base, diode 320, resistor 322 and diode 314. Similarly, transistor 312 is turned on by the input current from supply conductor 316 through its emitter to base, diode 328, resistor 330 and diode 324. With transistors 310 and 312 turned on the supply voltage conductor 316 is connected respectively with the supply conductors 234 and 234' of the clutch control circuits. Also, with transistor 288 turned on the capacitors 298 and 300 are connected to ground through the resistor 296 and the transistor 288 so that the input signal paths 306 and 308 are enabled.

In summary, the signal pulse from commutator segment number 9 causes the rotation of motor 16 to change from reverse to forward and, at the same time, enables operation of the clutch control means 230. This starts the positioning cycle.

POSITIONING CYCLE

In the positioning cycle, with the motor 16 rotating in the forward direction, the position clutches of the respective modules are under the control of command signals produced by the card reader. For any of the display modules, for example, the first display module with the clutch control circuit **230*a*, the positioning clutch will be deactuated until a command signal is applied to the clutch control circuit. A command signal will be applied to the input 224*a* of the clutch control circuit 230*a* whenever the commutator brush 232 engages a segment which is connected with a contact row in the card reader at which there is a hole in the punch card in the column corresponding to the first display module. In the Hollerith code which is used in the exemplary embodiment, there will be zero one or two holes per column in the punch card. Until the first hole is encountered in the scanning of the card reader rows by the commutator brush, the display module remains at rest, showing a blank (absence of a character display) at the home position. When the first hole is encountered, for example, at segment number 7, the command signal in the form of a pulse is applied through the conductor 224*a* to the gate of the SCR 232, turning on the SCR. This energizes the solenoid winding 148*a* and the positioning clutch is engaged. Accordingly, the corresponding display module is driven in the forward direction at least until the commutator segment reaches the zero segment. The zero segment is connected through a conductor 308 (see FIG. 16) which is connected through a diode 304 to the capacitors 298 and 300 (see FIG. 18). The positive pulse on conductor 308 is applied through the capacitors to the cathodes of diodes 320 and 328, respectively, which momentarily blocks the input current to the transistors 310 and 312, respectively. This momentarily turns off the transistors 310 and 312 and momentarily turns off all of the SCRs 232 in the clutch control circuits. However, if the second hole in the punch card column occurs at the zero row, there will be a positive pulse on the conductor 224*a* to the gate of the SCR 232 at the zero position. Consequently, the SCR will be turned on again when the supply voltage is restored through the transistor 310. This momentary deenergization of the solenoid winding 148 occurs in less time than that required to disengage the positioning clutch and consequently the clutch continues to drive the display module beyond the zero position of the commutator brush. If there were no hole in the punch card at the zero row, the solenoid coil 148*a* would be deenergized and the clutch would be disengaged, causing the display module to stop. If there were a hole at the 11 segment or the 12 segment, the command signal would be applied to the conductor 224*a* turning on the SCR 232 and reengaging the clutch. When the commutator segment reaches segment A the positive pulse is supplied through a conductor 306 and through the diode 302 to the capacitors 298 and 300 (see FIG. 18). This positive pulse is applied to the diodes 328 and 320 respectively, which as described, turns off the transistors 312 and 310, respectively. This shuts off all of the SCRs in the clutch control circuits and any display modules which were not previously stopped are brought to a stop at the shaft position corresponding to segment A. The motor shaft continues to turn until commutator brush 32 reches segment S which is connected through a conductor 338 (see FIG. 16) to the input 2 of the NAND gate 340 (see FIG. 18). The NAND gate 340 has its input 1 connected with the output of the AND gate 286 which is in a true state. Accordingly, the positive pulse on conductor 338 switches the NAND gate 340 from a true to a false state. The output of NAND gate 340 is applied to the input 1 of NAND gate 342 which has its input 2 connected with the output of the OR gate 264. The OR gate 264, at this time, is in a true state. The false state of NAND gate 340 causes the NAND gate 342 to switch from false to true. The output of NAND gate 342 is applied to both inputs 1 and 2 of a NAND gate 344 which is thereby switched from true to false. The output of the gate 344 is connected to the input 2 of the AND gate 260 which is switched from true to false. The false state of AND gate 260 causes the OR gate 264 to switch from true to false. With AND gate 260 in the false state the AND gate 286 is also in the false state and the transistor 288 is turned off. This causes the voltage on the collector of transistor 288 to go high and this high voltage is applied to the base of transistor 290, turning it off. This causes transistor 292 and transistor 294 to turn off and the motor 16 is deenergized. The motor shaft is brought to a stop with the commutator brush 32** on the S segment and the system is now at the rest position and ready to go through the reset and positioning cycle again.

SYSTEM OPERATION

The operation of the sign positioning system will now be described, it being noted that the operation of the several subsystems has been as described above. When it is desired to display a new name in the sign, a punch card 200 enclosed with the desired name is inserted into the card reader 202. This closes the start switch 22 which supplies a signal through a conductor 258 to the motor control circuit 250 of FIG. 18 which energizes the motor 16 for reverse rotation. This initiates the reset cycle and the control logic section 252 provides a control signal to the supply voltage control section 256 which turns off transistors 310 and 312 and disconnects the supply voltage from the clutch control means 230. It also disables the input signal paths 306 and 308. This prevents actuation of the positioning clutches during the reset cycle.

With the motor energized in the reverse direction, the motor shaft is rotated in a counterclockwise direction (as viewed from the left end in FIG. 8) and the commutator brush 32 is rotated in a clockwise direction (as viewed in FIG. 16). During the reset cycle each of the positioning clutches is deactuated, i.e. the solenoid is deenergized and the latch body is pivoted so that the latch roller 156 is in a detent notch in the planet carrier 162 tending to hold it against rotation. The counterclockwise rotation of the shaft causes the ring gear carrier 126 to be driven in a clockwise direction (as viewed from the left end in FIG. 8) and any slack or lost motion in the stack of dog washers 128 will be taken up. It will be understood that such lost motion occurs in a given positioning clutch during the reset cycle until the rotative position of the shaft reaches that position corresponding to the rotative position of the display module. When the shaft reaches this rotative position, the stack of dog washers 128 is wound up tight and is held fast by engagement with the stop pin 136. When this stop is reached, the ring gear carrier 126 will be in a rotative position so that a detent notch 162 is opposite the latch roller 158. Accordingly, the continued counterclockwise rotation of the shaft will drive the planet carrier 122 and output gear 162 in the counterclockwise direction, since the planet carrier will be released by ratcheting action of the latch body 144. The output gear 162 thus drives its respective display module from its previously set position, back to its home position where the motor is stopped and reenergized in the forward direction at the initiation of the positioning cycle.

At the end of the reset cycle, when the commutator brush 32 reaches segment number 9, the pulse from the magnetic switch 38 is applied to the input of the gate 270 of the control logic section 252. This causes the motor reversing circuit 254 to reverse the energization of the motor 16 and at the same time it causes the supply voltage control section 256 to turn on the transistors 310 and 312 and supply voltage to the clutch control means 230. Also the input signal paths 306 and 308 are enabled for the section 256. The positioning cycle commences with the commutator brush 32 on segment number 9 and with the brush rotating in a counterclockwise direction.

Figure 17:
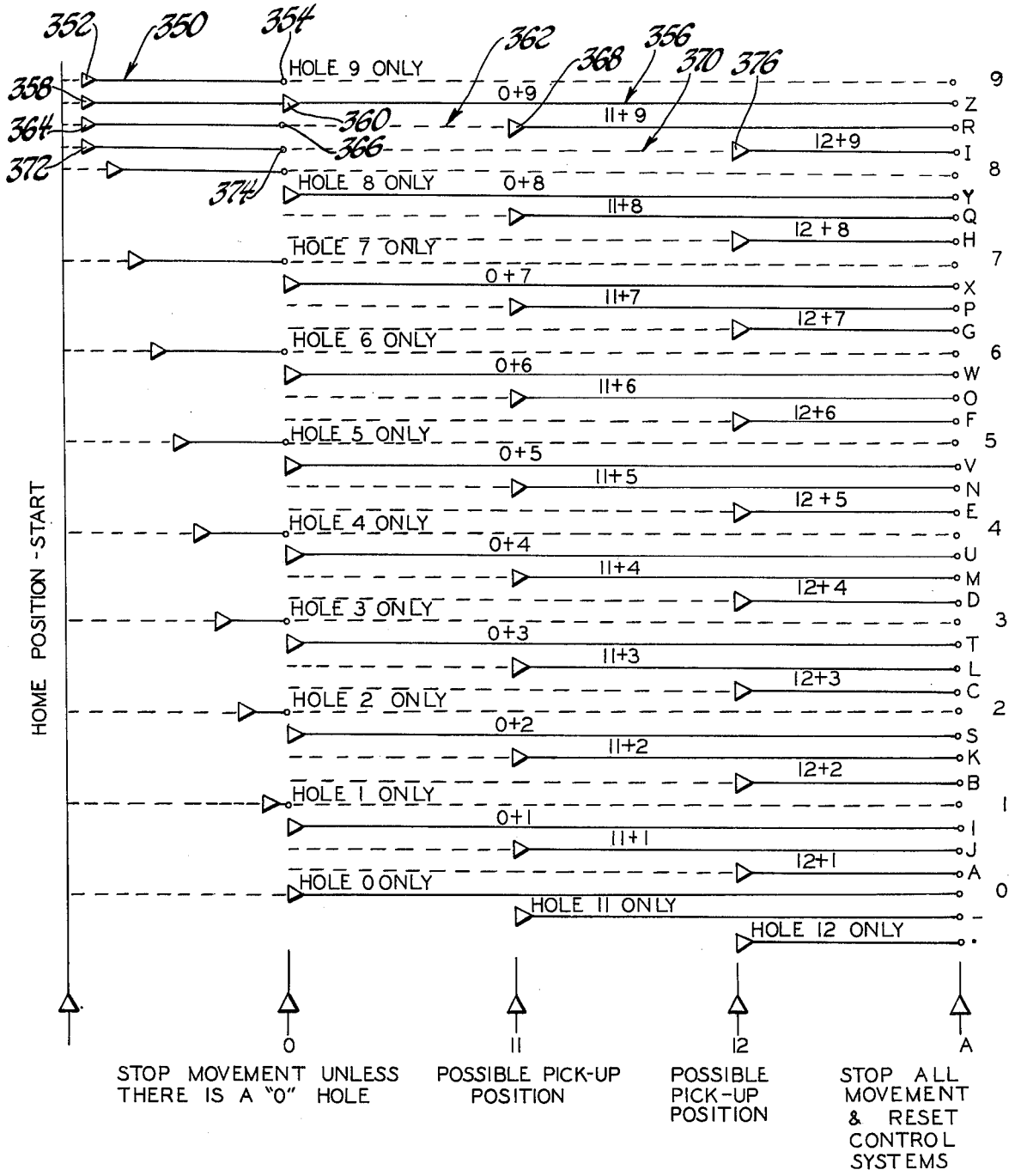
FIG. 17 is a chart to aid explanation of operation.

A description of operation during the positioning cycle will be facilitated by reference to the chart of FIG. 17. In this chart, the vertical line at the left-hand side represents the home position for all of the display modules. In this home position the display modules show a blank display and the commutator brush is at the segment number 9. The vertical line at the right-hand side of the chart represents the shaft position corresponding to commutator segment A. This is the maximum displacement position for any module. In a given positioning cycle, any module may have a displacement ranging from zero, represented by the left side of the chart, to the maximum displacement, represented by the right-hand side of the chart. The display module may have any intermediate value of displacement in increments equal to one-quarter turn off the module rollers which is equivalent to the lineal displacement between character segments. Attention is called to the legend in the chart FIG. 17 which shows the symbols used in the chart. It is noted that there are 39 different horizontal lines across the chart and each different line represents the displacement of the display module for a different character display; the alphanumeric character corresponding to each horizontal line is given at the right-hand end of the line. Thus the module can be displaced to any one of 39 different positions to display a selected character or it may remain in the home position to display a blank.

With further reference to the chart of FIG. 17, the operation in the position cycle will be explained for displaying several different characters. For example, if the column of the punch card for the given module has a hole at row 9 only, the system operation is represented by line 350 of the chart. When the commutator brush 32 is on the segment number 9 a pulse is transmitted to a clutch control 234 and the clutch is engaged at the position represented by the arrow head 352. The display module is driven until the commutator brush reaches the segment number 0 represented by the circle 354 on the chart. The momentary pulse supplied through conductor 308 to the supply voltage control circuit 256 causes the clutch to be disengaged and held in position. Since there is no other hole in the given column of the punch card the clutch remains disengaged while the shaft continues to rotate to the rest position in which the commutator brush 32 engages the commutator segment S. The operation just described positions the display module so that it displays the character "9". The next line 356 of the chart depicts the displacement of the display module when the given column of the punch card has a hole at row 0 and at row 9. In this operation, the positioning clutch is engaged with the commutator brush on segment number 9 and the module in the position represented by the arrow head 358. The module is displaced until the commutator brush reaches segment number 0 with the module in the position represented by the arrow head 360. At this position, the clutch remains engaged because of the hole at row 0 and consequently the module is displaced until the commutator brush reaches segment A. At segment A a positive pulse or conductor 206 turns off transistors 310 and 312 and the positioning clutch is disengaged bringing the module to a stop. This causes the module to display the character "Z". Another example is represented by line 362 wherein the given column of the punch card has holes at row 9 and row 11. Here the clutch is engaged when the commutator brush is at segment number 9, as indicated by arrow head 264, and it is disengaged when the brush reaches commutator segment number 0, as indicated by circle 366. Accordingly, there is no displacement of the module during the travel of the commutator brush from segment number 0 to segment number 11. When the commutator brush reaches segment number 11 the clutch is reengaged, as indicated by arrow head 368, and the module is displaced until the commutator brush reaches segment A. In this position the module displays the character "R". A further example is represented by line 370. In this example the given column of the punch card has a hole at row 9 and a hole at row 12. The clutch is first engaged with the commutator brush at segment number 99 and the module in the position represented by the arrow head 372. It remains energized until the commutator segment reaches segment number 0 with the module in position represented by the circle 374, at which point the clutch is disengaged. It remains disengaged until the commutator brush reaches segment number 12 where the hole in the punch card causes it to be reengaged with the module at the position represented by the arrow head 376. The clutch remains engaged unti the commutator brush reaches segment A where the module stops and remains on display. The module displays the character "I" in this position.

The system is operative in the same manner to display any of the other characters which are listed along the righthand side of the chart of FIG. 17. After the module is set to the commanded position by the accumulative motion during the positioning cycle, the selected character remains on display until another punch card is inserted into the card reader to initiate the reset cycle. The positioning cycle is then repeated immediately after the reset cycle.

Although the description of this invention has been given with reference to a particular embodiment, it is not to be construed in a limiting sense. Many variations and modifications will now occur to those skilled in the art. For a definition of the invention, reference is made to the appended claims.

The embodiments of the present invention in which an exclusive property of privilege is claimed are defined as follows:

1. In a changeable sign, apparatus for positioning a plurality of display devices in individually selectable rotative positions, a common drive shaft for all of said devices, a reversible motor connected with the drive shaft, a separate clutch means for each device adapted to be engaged for coupling the respective device to the drive shaft, selector means for producing a desired position signal for each device, shaft position encoding means connected with said drive shaft and adapted to produce a shaft position signal, motor control means connected with the shaft position encoding means for energizing the motor in a reverse direction to drive each device to a home position and energize it in a forward direction when the home position is reached, said encoded means being connected with said selector means to cause the selector means to produce a command signal when the shaft position signal bears a predetermined relation to the desired position signal for each device, clutch control means connected with the clutches and the selector means and being responsive to the command signals for selectively engaging each of the clutch means to couple the respective devices to the shaft during shaft displacement corresponding to the rotational distance between the home position and the desired position for the respective device.

2. The invention as defined in claim 1 wherein said clutch means includes an input member connected with said shaft and an output member connected with said device, clutch operating means for coupling the input member with the output member when the operating member is actuated, said operating member including means for braking said output member when the operating member is deactuated, said clutch operating means being connected with said clutch control means for actuation in response to a command signal.

3. The invention as defined in claim 2 wherein said clutch means includes an auxiliary clutch operating means for coupling the input member to the output member while said motor is energized in a reverse direction.

4. The invention as defined in claim 3 wherein said auxiliary clutch operating means includes memory means connected with said drive shaft while said operating member is deactuated for counting the shaft revolutions when the output member is being braked and including means for coupling said input member to said output member when the shaft is rotated in a reverse direction by a number of revolutions in excess of the number stored in said memory means.

5. The invention as defined in claim 1 wherein said clutch means comprises a differential gear set having an input gear connected with said drive shaft, an output gear connected with said device and a control gear, said operating member including means for braking the control gear when actuated and thereby coupling the input member to the output member, said operating member including means for braking said output gear when deactuated.

6. The invention as defined in claim 5 wherein said differential gear set is a planetary gear set with a sun gear being said input gear, a planetary gear being said output gear and a ring gear being said control gear.

7. The invention as defined in claim 6 including a fixed member, and a rotary lost motion connection between said ring gear and said fixed member whereby the lost motion connection is extended while the planetary gear is braked with the motor energized in the forward direction and the lost motion connection is retracted when the planetary gear is braked with the motor running in the reverse direction so that the lost motion connection brakes the ring gear and connects the sun gear with the planet gear, after the lost motion is taken up, to drive the respective device to its home position.

8. The invention as defined in claim 7 wherein said operating member comprises a latch member having a first latch element engageable with said planetary gear carrier at discrete angular positions thereof, a second latch element engageable with the ring gear at discrete angular positions thereof, and actuating means for causing one of the latch elements to be engaged and the other latch element to be disengaged and for alternately causing said other latch element to be engaged and said one latch element to be disengaged.

9. The invention as defined in claim 8 wherein said latch member comprises a body pivotally mounted on said fixed member and said first and second latch elements comprise first and second rollers rotatably mounted on said body on opposite sides of the pivot axis thereof, said planetary gear carrier having plural detent notches equally spaced around the circumference thereof, each being adapted to receive said first roller, said ring gear carrier having a plurality of detent notches equally spaced around the circumference thereof, each adapted to receive said second roller.

10. The invention as defined in claim 9 wherein said lost motion connection comprises a stack of dog washers.

11. The invention as defined in claim 2 wherein said encoding means comprises a plurality of conductive elements corresponding to discrete rotative positions of said shaft and means for applying a voltage to the element which corresponds to the existing position of the shaft, said motor control means being connected with selected ones of said conductive elements.

12. The invention as defined in claim 11 wherein said selector means comprises a set of switches corresponding to each of said clutch means, there being a number of switches in each set equal to the number of said conductive elements with each switch of a set being connected with a different one of said conductive elements, all of said switches in a set being connected with said clutch control means for the respective clutch, and means for selectively actuating said switches according to the desired position for the respective device to actuate the respective clutch when the shaft reaches a predetermined rotative position.

13. The invention as defined in claim 12 including disabling means connected with said motor control means and said clutch control means for disabling the clutch control means when said motor is energized in a reverse direction.

14. The invention as defined in claim 2 wherein said encoding means is a commutator having a plurality of commutator segments and a slip ring, a voltage source connected with said slip ring, an armature driven by said drive shaft with a first brush engaging said slip ring and a second brush engaging said commutator segments.

15. The invention as defined in claim 14 wherein said selector means comprises a punch card reader.

16. The invention as defined in claim 12 wherein said motor control means is a logic circuit having one input connected with the conductive element of the encoding means which corresponds with the rest position of said shaft and another input connected with the conductive element which corresponds with the home position of said shaft.

17. The invention as defined in claim 15 wherein the motor control means is a logic circuit having one input connected with the commutator segment corresponding to the rest position of the shaft and another input connected with the commutator segment corresponding to the home position of said shaft and a start switch in said card reader for energizing the motor control circuit when a punch card is inserted.

18. The invention as defined in claim 2 wherein said clutch control means comprises a solenoid connected with said clutch operating member and switching means connected between the selector means and the solenoid.

19. The invention as defined in claim 18 wherein said switching means is a silicon controlled rectifier.

20. The invention as defined in claim 11 wherein said means for applying the voltage comprises a pulse generator operated synchronously with rotation of said shaft.

21. The invention as defined in claim 20 wherein said pulse generator comprises a magnet operated switch and a magnet mounted on said shaft for rotation therewith to operate the magnet operated switch.

* * * * *

CERTIFICATE OF CORRECTION

Patent No. 4,064,502 Dated December 20, 1977

Inventor(s) William H. Saylor and James O. Narey

It is certified that error appears in the above-identified patent and that said Letters Patent are hereby corrected as shown below:

Col. 1, line 6 after "abandoned" insert --Field of the Invention. This invention relates to information displays such as signs which are made up of alphanumeric characters printed on roller tapes. More particularly, this invention relates to positioning control systems of the open-loop type adapted to selectably position the plural characters of alphanumeric displays.--.
Col. 2, line 20 "respective" should be --responsive--.
Col. 4, line 38 "62a" should be --62b--.
Col. 4, line 59 "if" should be --is--.
Col. 5, line 2 "shft" should be --shaft--.
Col. 7, line 64 after "limit" delete --to--.
Col. 9, line 25 "positoning" should be --positioning--.
Col. 9, line 34 after "carrier" insert --126 thus stopping its rotation and forcing the planet carrier--.
Col. 9, line 68, "primy" should be --prime--.
Col. 14, line 50 "25" should be --252--.
Col. 17, line 35 "22" should be --222--.
Col. 18, line 51 "position" should be --positioning--.
Col. 18, line 57 after "control" insert --circuit--.
Col. 19, line 14 "206" should be --306--.

UNITED STATES PATENT OFFICE

CERTIFICATE OF CORRECTION

Patent No. 4,064,502 Dated December 20, 1977

Inventor(s) William H. Saylor and Jemes O. Narey

It is certified that error appears in the above-identified patent and that said Letters Patent are hereby corrected as shown below:

Col. 19, line 34 "99" should be --9--.
Col. 19, line 43 "unti" should be --until--.
Col. 19, line 63 (second line of introduction to claims), "of" should be --or--.
Col. 20, line 18 "devices" should be--device--.
Col. 14, line 3 "signa" should be --signal--.

Signed and Sealed this

Twenty-third Day of May 1978

[SEAL]

Attest:

RUTH C. MASON
Attesting Officer

LUTRELLE F. PARKER
Acting Commissioner of Patents and Trademarks